United States Patent [19]

Smith et al.

[11] Patent Number: 4,960,534

[45] Date of Patent: Oct. 2, 1990

[54] METHOD OF THICKENING AN AQUEOUS SOLUTION OF SULPHAMIC ACID

[75] Inventors: Douglas N. Smith; Howard Goodman, both of St Austell, United Kingdom

[73] Assignee: ECC International Limited, United Kingdom

[21] Appl. No.: 304,802

[22] Filed: Jan. 31, 1989

[30] Foreign Application Priority Data

Feb. 1, 1988 [GB] United Kingdom ..... 8802161

[51] Int. Cl.[5] ..... C11D 7/08

[52] U.S. Cl. ..... 252/145; 252/142; 252/174.25; 252/DIG. 14

[58] Field of Search ..... 252/100, 142, 145, DIG. 14, 252/174.25

[56] References Cited

U.S. PATENT DOCUMENTS

| | | | |
|---|---|---|---|
| 2,672,449 | 3/1954 | Snell et al. | 252/100 |
| 2,868,732 | 1/1959 | Truc | 252/136 |
| 3,073,726 | 1/1963 | Freud | 134/3 |
| 3,268,455 | 8/1966 | Bryce et al. | 252/142 |
| 3,275,560 | 9/1966 | Wasserman et al. | 252/101 |
| 3,953,352 | 4/1976 | Mizutani et al. | 252/142 |
| 4,302,253 | 11/1981 | Ciullo | 106/208 |
| 4,532,066 | 7/1985 | Paszek et al. | 252/144 |
| 4,778,617 | 10/1988 | Shaer et al. | 252/146 |

FOREIGN PATENT DOCUMENTS

| | | |
|---|---|---|
| 426068 | 6/1967 | Switzerland . |
| 763394 | 12/1956 | United Kingdom . |
| 1572032 | 7/1980 | United Kingdom . |

*Primary Examiner*—Prince E. Willis

*Attorney, Agent, or Firm*—Klauber & Jackson

[57] ABSTRACT

There is disclosed a method for preparing a thickened cleaning composition containing sulphamic acid, according to which an aqueous suspension of a particulate smectite clay suspension is formed, which is mixed with the sulphamic acid to form a thickened aqueous solution of the acid.

8 Claims, No Drawings

METHOD OF THICKENING AN AQUEOUS SOLUTION OF SULPHAMIC ACID

This invention relates to a method of thickening an aqueous solution of an acid and particularly, but not exclusively, to a method of thickening an aqueous solution of an acid of the type which is used in domestic cleaning compositions, for example sulphamic acid ($HSO_3.NO_2$) which is commonly used in toilet-bowl cleaning compositions.

It is desirable to thicken domestic cleaning compositions to facilitate their handling and dispensing and to improve the adherence of the composition to the surface which it is desired to clean, in order to prolong the cleaning effect. Generally, an aqueous solution may be thickened by mixing therewith a hydrophilic organic polymer. However, when the solution contains a strongly acidic compound it has proved difficult to find a polymer which will withstand the low pH values and provide the required viscosifying effect over a prolonged period of storage.

Inorganic mineral thickeners, such as smectite clays, are known not to disperse well in acidic solutions as their swelling can be inhibited at low pH values. It is shown below (see Example 6) that a solution of sulphamic acid to which a particulate smectite clay has been directly added has a gritty texture and the clay tends to flocculate to form discrete flocs which are separated by visible expanses of clear liquid.

According to a first aspect of the present invention, there is provided a method for preparing a thickened aqueous solution of an acid, comprising the steps of:

(a) forming an aqueous suspension of a particulate smectite clay; and (b) mixing the aqueous suspension with the acid to form a thickened aqueous solution of the acid.

In step (b), the acid which is combined with the aqueous suspension may be an aqueous solution of the acid or the acid in solid form, for example particulate solid form. Preferably, the acid is sulphamic acid ($HSO_3.NO_2$). The acid might also be hydrochloric acid, phosphoric acid or hydrofluoric acid.

The smectite clay used may be, for example, bentonite, montmorillonite, hectorite, saporite or beidellite. Mixtures of two or more different clays may be used. Preferably, substantially all of the particles of smectite clay should pass through a No. 300 mesh British Standard sieve (nominal aperture 76 microns). Most preferably, substantially all of the particles should pass through a No. 200 mesh British Standard sieve (nominal aperture 53 microns).

In step (a), the smectite clay is normally used in an amount such as to provide an aqueous suspension containing no less than about 1.0% by weight of the smectite clay, and preferably no more than about 15.0% by weight of the clay. Preferably, in the final composition, the smectite clay should be present in an amount of from 1% to 15%, preferably at least 3%, by weight of the smectite clay.

In step (b), the amount of acid added is preferably such as to provide a final composition which contains from about 1% to about 15% by weight of the acid.

It is preferred that the aqueous suspension of particulate smectite clay is uniform. This may be prepared by subjecting the initial suspension, formed by mixing clay and water, to vigorous agitation.

Preferably, the acid and the smectite clay suspension are mixed together using vigorous agitation. Immediately after mixing, the thickened aqueous solution of acid should preferably have a viscosity of at least 500 m.Pas, as measured by a Brookfield Viscometer at a spindle speed of 2.5 rpm.

The present invention also provides a thickened aqueous solution of an acid, whenever prepared by the method according to the first aspect of the present invention.

A thickened solution of phosphoric acid would be useful in treating rust whilst a thickened solution of hydrofluoric acid would be useful in etching glass or similar material.

According to another aspect of the present invention there is provided a method for preparing a thickened cleaning composition comprising a homogeneous suspension of a smectite clay in an aqueous solution of an acid, which method comprises the steps of (a) forming an aqueous suspension of the smectite clay; and (b) mixing the aqueous suspension with the acid to form a homogeneous thickened cleaning composition.

The invention also provides a thickened cleaning composition made by a process in accordance with the second aspect of the invention.

The cleaning composition may further comprise, for example, a perfume and a colouring agent.

The invention will now be illustrated by the following Examples.

EXAMPLE 1

A solution containing 10% by weight of sulphamic acid was prepared by adding 10 g of the acid in dry granular form to 90 g of water and agitating the mixture by means of a Cowles blade stirrer rotating at 1000 rpm until all the acid had dissolved. An aqueous suspension containing 2% by weight of bentonite clay was then prepared by adding to 98 g of water 2 g of a bentonite clay which had a particle size distribution such that 99% by weight passed through a No. 300 mesh British Standard sieve (nominal aperture 53 microns) and a cation exchange capacity of 80 meq/100 g. The mixture was agitated by means of the Cowles blade stirrer rotating at 1000 rpm for 15 minutes. The sulphamic acid solution was then added to the bentonite suspension with stirring at a speed of 1000 rpm for about 20 seconds. The speed of the Cowles blade stirrer was then increased to 3000 rpm and stirring was continued for 5 minutes. The viscosity of the resultant composition was then measured by means of a Brookfield Viscometer, at spindle speeds of 2.5 and 50 rpm respectively, immediately on completion of the preparation of the suspension and after 10 days storage.

EXAMPLE 2

The experiment described in Example 1 above was repeated except that the aqueous bentonite suspension contained 4% by weight of bentonite so that the final composition contained 2% by weight of bentonite.

EXAMPLE 3

The experiment described in Example 1 above was repeated except that the aqueous bentonite suspension contained 6% by weight of bentonite so that the final composition contained 3% by weight of bentonite.

EXAMPLE 4

The experiment described in Example 1 above was repeated except that the aqueous bentonite suspension contained 8% by weight of bentonite so that the final composition contained 4% by weight of bentonite.

The results obtained in Examples 1 to 4 above are set forth in Table 1 below:

TABLE I

| | Example No | 1 | | 2 | | 3 | | 4 | |
|---|---|---|---|---|---|---|---|---|---|
| Viscosity (mPas) | % by wt bentonite | 1.0 | | 2.0 | | 3.0 | | 4.0 | |
| | pH | 1.3 | | 1.3 | | 1.3 | | 1.4 | |
| | Spindle speed (rpm) | 2.5 | 50 | 2.5 | 50 | 2.5 | 50 | 2.5 | 50 |
| | Immediately on completion | 530 | 45 | 4000 | 280 | 8000 | 690 | 18400 | 1235 |
| | After storage for 10 days | 430 | 40 | 3745 | 210 | 13760 | 645 | 23000 | 1560 |

The compositions prepared in Examples 1 to 4 are thus seen to be thixotropic, or shear thinning, and to possess good stability on storage.

EXAMPLE 5

An aqueous suspension containing 3% by weight of bentonite was prepared by mixing 6 g of the same bentonite as was used in Example 1 with 194 g of water with agitation by means of a Cowles blade stirrer rotating at 1000 rpm for 15 minutes. To this slurry there was added 20 g of dry sulphamic acid while continuing stirring for about 10 minutes until all the acid had dissolved. The viscosity of the resultant thixotropic gel was measured, by means of the Brookfield Viscometer at spindle speeds of 2.5 to 50 rpm respectively, immediately on completion of preparation of the suspension and after 3 days storage, and the results obtained are set forth in Table II below:

TABLE II

| | | | |
|---|---|---|---|
| | % by weight of bentonite | 3.0 | |
| | spindle speed | 2.5 | 50 |
| Viscosity (mPas) | Immediately on completion | 14680 | 688 |
| | After storage for 3 days | 12920 | 650 |

EXAMPLE 6

(comparative)

In this comparative Example 3 g of the same bentonite as was used in Example 1 was added to 97 g of a 10% by weight solution of sulphamic acid in water with agitation by means of the Cowles blade stirrer rotating at 1000 rpm for 15 minutes the resultant suspension had a gritty texture and contained discrete flocs of bentonite separated by visible expanses of clear liquid.

We claim:

1. A method for preparing a thickened cleaning composition containing sulphamic acid, consisting essentially of the following steps:

(a) forming an aqueous suspension of a particulate smectite clay; and (b) mixing the aqueous suspension with the sulphamic acid to form a thickened aqueous solution of the acid.

2. A method according to claim 1, wherein the smectite clay is used in an amount such that the aqueous suspension contains no less than 1.0% by weight of the smectite clay.

3. A method according to claim 1, wherein the smectite clay is used in an amount such that the aqueous suspension contains no more than 15.0% by weight of the smectite clay.

4. A method according to claim 1, wherein the smectite clay is selected from: bentonite, montmorillomite, hectorite, saporite or beidellite or a mixture thereof.

5. A method according to claim 1, wherein the acid which is combined with the aqueous suspension is an aqueous solution of the acid or the acid in particulate solid form.

6. A method according to claim 1, wherein, in step (b), the amount of acid added is such as to provide a final composition which contains from about 1% to 15% by weight of the acid.

7. A method according to claim 1, wherein the acid and the smectite clay suspension are mixed together using vigorous agitation.

8. A liquid cleaning composition consisting essentially of an aqueous solution of sulphamic acid, thickened with a particulate smectite clay.

* * * * *